United States Patent [19]

Nelson

[11] Patent Number: 4,522,314

[45] Date of Patent: Jun. 11, 1985

[54] TOOTHPICK DISPENSER

[76] Inventor: Alexander Nelson, 1027 E. Pleasant St. #303, Milwaukee, Wis. 53202

[21] Appl. No.: 476,055

[22] Filed: Mar. 17, 1983

[51] Int. Cl.[3] ..... A24F 15/04

[52] U.S. Cl. ..... 221/190; 221/254; 221/312 C; 206/380

[58] Field of Search ..... 206/380; 221/65, 186, 221/190, 191, 192, 209, 210, 220, 254, 256, 260, 312 R, 312 C

[56] References Cited

U.S. PATENT DOCUMENTS

| | | | |
|---|---|---|---|
| 1,077,715 | 11/1913 | Hughes | 221/220 |
| 3,982,660 | 9/1976 | Hashimoto | 221/190 |

FOREIGN PATENT DOCUMENTS

| | | | |
|---|---|---|---|
| 608623 | 4/1926 | France | 221/190 |
| 17872 | 3/1899 | Switzerland | 221/190 |
| 1014957 | 12/1965 | United Kingdom | 221/190 |

*Primary Examiner*—Joseph J. Rolla

*Attorney, Agent, or Firm*—Andrus, Sceales, Starke & Sawall

[57] ABSTRACT

A toothpick dispenser for vertically dispensing a toothpick includes a stationary base having an upright cylindrical housing, and a cylindrical body for containing toothpicks which is telescopically received within the housing for vertical sliding movement therein. An upstanding stationary support stand projects axially from the base within the housing, and the movable body includes a cone-shaped bottom that slopes inwardly and downwardly toward a central opening which slidably receives the support stand. When the body is moved upwardly to its loading position a single toothpick passes through the opening in its bottom and is received on end by the stand. When the body is moved downwardly to its dispensing position the stand closes the opening in the cone and the toothpick projects from the body in an upright vertical positon. The dispenser also includes a removable cover for the body having a guide member for directing the toothpick through an opening in the cover.

5 Claims, 5 Drawing Figures

FIG. 1.
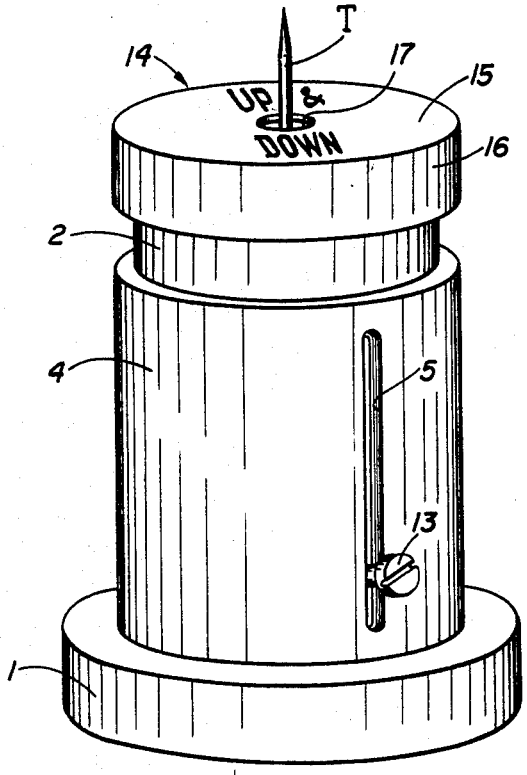
FIG. 3.
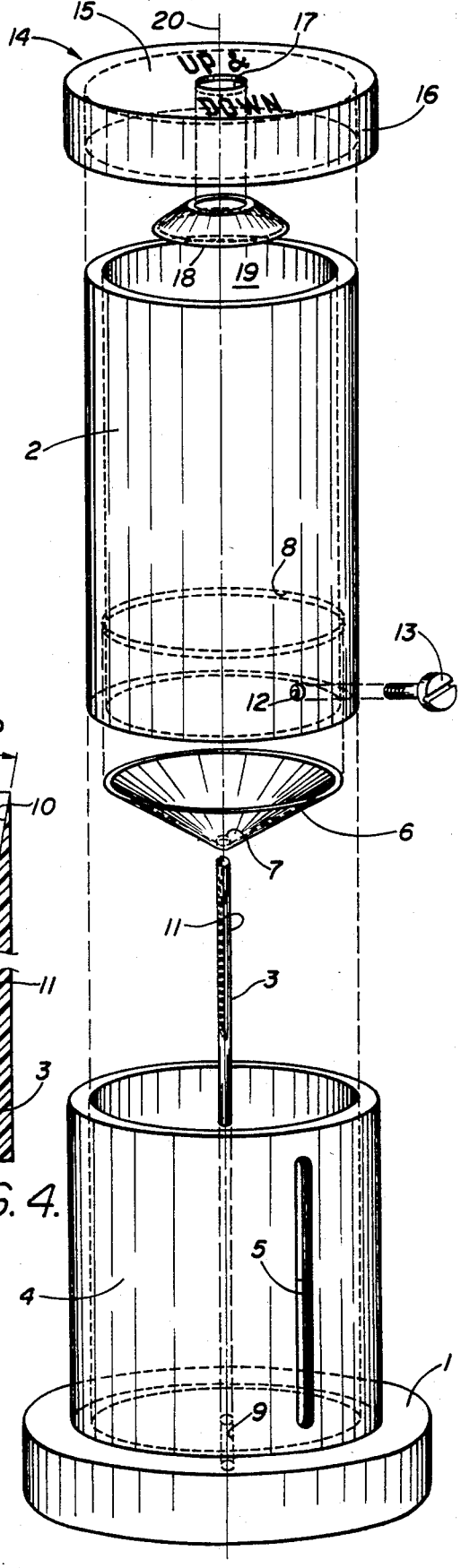
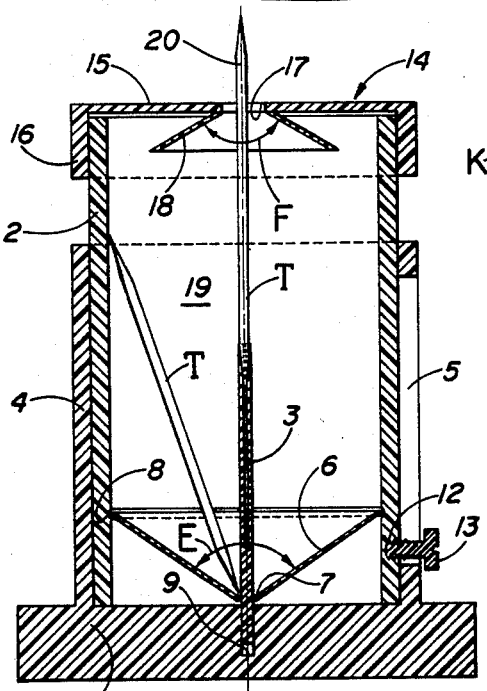
FIG. 2.
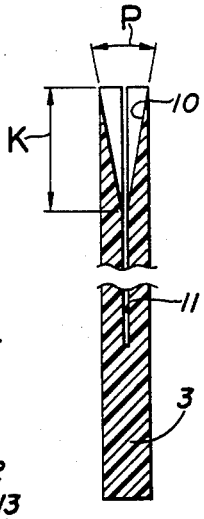
FIG. 4.
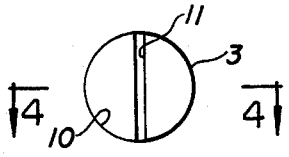
FIG. 5.

TOOTHPICK DISPENSER

BACKGROUND OF THE INVENTION

The present invention relates to toothpick dispensers, and more particularly to a toothpick dispenser for dispensing a toothpick in a vertical position.

Various types of toothpick dispensers are known in the art. For example, U.S. Pat. No. 4,269,313 shows a toothpick dispenser with a rotating cap that moves a single toothpick to a discharge chamber. The device is then inverted and the single toothpick drops out.

U.S. Pat. Nos. 1,832,735 and 1,648,448 each show toothpick dispensers having a body for containing the toothpicks and a perforated cap. In order to dispense a toothpick, the body is tipped and shaken so that the toothpicks fall through the openings in the cap.

In addition to the above, the following patents illustrate various types of toothpick holders: U.S. Pat. Nos. 2,788,154, 2,319,570, 1,785,107, 1,385,288, 1,280,803, 647,187, 469,064, 281,731, and U.S. Pat. No. Des. 257,912 and 167,532.

SUMMARY OF THE INVENTION

The present invention relates to a toothpick dispensing device for use in dining rooms, restaurants, bars, cafes, hotels and the like.

The primary object of the invention is to provide a simple sanitary device for dispensing toothpicks one at a time. The sanitary feature of the invention is due to the fact that the toothpick need not be touched by any person other than the person who takes the toothpick from the dispenser.

A further object of the invention is to provide a toothpick dispensing device which is relatively simple in construction, durable in use and high efficient in operation.

While researching the present invention, the following goals were formulated: (1) to reduce the complexity of prior art toothpick dispensers; (2) to avoid the use of expensive metal components; (3) to simplify the method of taking a toothpick from a dispensing device; and (4) to simplify the process of manufacturing a toothpick dispenser.

The above objects were accomplished by providing a toothpick dispenser having a base with an upright cylindrical housing, and a cylindrical body having an open end and a closed end containing toothpicks longitudinally therein. The body is telescopically received within the housing for axial sliding movement therein between an upper loading position and a lower dispensing position. The base includes an upstanding support stand for receiving a single toothpick on its end when the body is moved to its loading position so that the toothpick projects vertically from the body when the body is moved downwardly to its dispensing position.

BRIEF DESCRIPTION OF THE DRAWINGS

The drawings illustrate the best mode presently contemplated of carrying out the invention.

In the drawings:

FIG. 1 is a view in elevation of the toothpick dispenser of the present invention;

FIG. 2 is a vertical sectional view of the dispenser of FIG. 1;

FIG. 3 is an exploded view of the components of the toothpick dispenser of FIGS. 1 and 2;

FIG. 4 is a vertical sectional view of a support stand taken along the plane of the line 4—4 in FIG. 5; and FIG. 5 is a plan view of the support stand of FIG. 4.

DESCRIPTION OF THE PREFERRED EMBODIMENT

Referring now to the drawings, FIGS. 1–3 illustrate a toothpick dispenser constituting a preferred embodiment of the present invention. As shown, the dispenser has a central longitudinal axis 20. The dispenser includes a stationary base 1, a vertically movable body 2 containing a plurality of toothpicks T (only one of which is shown), and an upstanding support stand 3 for receiving a single toothpick T on its end, as will hereinafter be described. Base 1 includes a hollow upright cylindrical housing 4 that projects vertically therefrom. Housing 4 is preferably formed in one piece with base 1, and comprised of a plastic material to provide a relatively lightweight but durable device. Housing 4 also includes a longitudinal slot 5 formed in its side wall which extends axially for substantially the entire height of housing 4. The purpose of slot 5 will hereinafter be described.

Body 2 is cylindrical in shape and has an outer diameter substantially the same as the inner diameter of housing 4 so that it may be telescopically received within housing 4 for vertical sliding movement therein. Body 2 provides a container or hopper 19 for the toothpicks T, and as seen best in FIG. 2 the toothpicks T are disposed therein in substantially vertical positions. Body 2 includes a cone-shaped bottom 6 which provides a closure for its lower end. Bottom 6 slopes inwardly and downwardly toward a central opening 7. An angle E of bottom 6 is about 110°. Bottom 6 is held in position in the lower end of body 2 by means of an annular groove 8 formed in the inner circumference of body 2 which engages the top edge of bottom 6.

Support stand 3 comprises a long, narrow upstanding member which is positioned along the longitudinal central axis 20 of body 2 and housing 4. As seen best in FIG. 2, the lower end of stand 3 is received within a hole 9 formed in base 1 so that stand 3 projects axially from base 1 in an upright manner. Hole 9 is positioned along the longitudinal central axis 20 of the housing 4. Hole 9 has a diameter substantially equal to support stand 3 so that stand 3 is held therein in a press fit manner. Stand 3 is therefore slidable within hole 9 to adjust the height of its free end. As seen best in FIG. 4 and 5, the upper end of stand 3 includes a cone-shaped opening 10. Opening 10 has an angle P of about 15° and a height K of about 0.3125 inch which substantially corresponds to the tapered end of the toothpick T. The upper end of support stand 3 is also split into two pieces by means of a diametrically orientated cut 11 which extends from its free upper end downwardly to approximately the middle of stand 3. Cut 11 forms a pair of resilient fingers at the free end of stand 3, the purpose for which will hereinafter be described.

Body 2 also includes a radially extending threaded hole 12 formed in its lower end for receiving a screw 13 therein. Screw 13 provides a stop for limiting the axial sliding movement of body 2 by engaging the upper and lower ends of slot 5 in housing 4.

Body 2 includes a removable cover 14 which provides a closure for its upper end. Cover 14 includes a lid 15 having the legend "UP & DOWN" and an annular flange 16 projecting downwardly from the circumference of lid 15. Lid 15 includes a central opening 17 which is positioned substantially in alignment with the support stand 3 along the central axis 20 of body 2. A guide member 18 is positioned on the underside of lid 15 for insuring that the upper end of a toothpick is directed through central opening 17. Guide member 18 is in the form of a truncated cone having its smaller opening at its upper end which has a diameter substantially equal the diameter of opening 17 in lid 15. As shown in FIG. 2, and angle F of guide member 18 is about 120°.

In operation, body 2 is first positioned within housing 4 as shown in FIG. 2 with the opening 7 of bottom 6 slidably receiving support stand 3. In this position body 2 may be filled with toothpicks orientated in a substantially vertical manner. Cover 14 may then be placed over the open top of body 2 so that the dispenser is in its ready position. When it is desired to dispense a toothpick, body 2 is moved upwardly to its loading position. In its loading position, screw 13 engages the upper end of slot 5 and the central opening 7 in bottom 6 is located adjacent to the free end of support stand 3. In this position, a single toothpick T will pass through opening 7 and into cone-shaped opening 10 in stand 3 so that its tapered end is received within opening 10. Body 2 is then moved downwardly to a dispensing position so that the upper end of toothpick T extends from the central opening 17 in lid 15 substantially as shown in FIG. 2. If for any reason the upper end of toothpick T is not aligned with opening 17 when body 2 is moved downwardly, guide member 18 will engage its upper end and direct it through opening 17 as body 2 is forced downwardly.

If the upper end of a toothpick T which is positioned in its dispensing position extending vertically from cover 14 is pushed downwardly, the bottom end of toothpick T will be forced into the cut 11 formed in stand 3. Since cut 11 forms a pair of resilient members in the upper end of stand 3, these members readily separate upon a downward force on toothpick T so that there is no danger of puncturing the skin of a person. The depth of cut 11 is sufficient so that a toothpick T could be forced downwardly until its upper end is parallel with lid 15 to insure against injury.

A toothpick dispenser has been illustrated and described for use in dining rooms, restaurants, bars, cafes, hotels and the like. Preferably, all parts of the dispenser described herein are composed of a plastic material which reduces cost and simplifies manufacturing. Various modifications and/or substitutions may be made to the components specifically described herein without departing from the scope of the invention. For example, a different stop means may be utilized than the screw 13 and slot 5 arrangement specifically described herein, and some parts may be made of metal instead of plastic if desired.

Various modes of carrying out the invention are contemplated as being within the scope of the following claims particularly pointing out and distinctly claiming the subject matter which is regarded as the invention.

I claim:

1. A toothpick dispenser for dispensing a toothpick in a vertical position, comprising:

a stationary base having an upright cylindrical housing that defines a longitudinal axis, said base includes a closed bore formed therein along said axis;

a cylindrical body having an open top and a closed bottom for containing a plurality of toothpicks longitudinally on their ends in substantially vertical positions, said body telescopically received within said housing for vertical axial sliding movement therein between an upper loading position and a lower dispensing position, an upstanding support member projecting axially from said base within said housing for receiving a single toothpick on its end in an upright vertical position when said housing is moved to its loading position, said support member includes an axially extending cone-shaped opening in the free end thereof dimensioned to substantially correspond to the dimensions of a tapered end of a toothpick, said free end of said support member being split axially to provide a pair of resilient fingers to permit axial movement of a toothpick therein upon the application of a longitudinally directed force on a toothpick, and having its lower end slidably frictionally engaged in a press fit manner within said closed bore to permit adjustment of the height of the free end of said support member;

said closed bottom sloping inwardly and downwardly toward a central opening formed therein, said central opening dimensioned to slidably receive said support member so that when said body is moved upwardly to its loading position the lower end of a single toothpick passes through said central opening and is received by said support member and when said body is moved downwardly to its dispensing position said support member closes said opening and said toothpick projects axially from said body.

2. The toothpick dispenser of claim 1, further including stop means for limiting the axial sliding movement of said body.

3. The toothpick dispenser of claim 1, further including a cover providing a closure for the top of said body, said cover having an opening therein disposed in axial alignment with said support member.

4. The toothpick dispenser of claim 3, wherein said cover includes guide means on its inner side for guiding said single toothpick towards the opening in said cover.

5. The toothpick dispenser of claim 4, wherein said guide means is a cone-shaped member converging on the opening in said cover.

* * * * *